US006125483A

United States Patent [19]

Stroud et al.

[11] Patent Number: 6,125,483

[45] Date of Patent: Oct. 3, 2000

[54] COLLAPSIBLE PLAYYARD SYSTEM

[75] Inventors: David J. Stroud, Piqua, Ohio; Eric Chen, Tai Chia Yi Hsien, Taiwan

[73] Assignee: Evenflo Company, Inc., Vandalia, Ohio

[21] Appl. No.: 08/927,619

[22] Filed: Sep. 11, 1997

[51] Int. Cl.[7] ..... A47D 7/00

[52] U.S. Cl. ..... 5/99.1; 5/98.1; 5/93.1; 135/128; 403/97

[58] Field of Search ..... 5/99.1, 98.1, 98.3, 5/93.1; 135/128, 121; 403/97, 327

[56] References Cited

U.S. PATENT DOCUMENTS

| | | | |
|---|---|---|---|
| 4,811,437 | 3/1989 | Dillner et al. | 5/99.1 |
| 4,985,948 | 1/1991 | Mariol | 5/99.1 |
| 5,197,154 | 3/1993 | Shamie | 5/99.1 |
| 5,377,368 | 1/1995 | Cheng | 5/99.1 |
| 5,381,570 | 1/1995 | Cheng | 5/99.1 |
| 5,497,517 | 3/1996 | Wang | 5/99.1 |
| 5,542,134 | 8/1996 | Wang | 5/99.1 |
| 5,615,427 | 4/1997 | Huang | 5/99.1 |
| 5,781,944 | 7/1998 | Huang | 5/99.1 |

*Primary Examiner*—Carl D. Friedman
*Assistant Examiner*—Winnie Yip
*Attorney, Agent, or Firm*—Thompson Hine & Flory L.L.P

[57] ABSTRACT

A playyard system having an upper rail assembly with two parallel upper long side rails and two parallel upper short end rails. Each of the upper rails has a hinge with horizontal pivot pins adjacent to the midpoint thereof. The upper rail assembly also includes four upper corner brackets with hinges coupling the remote exterior ends of the four upper rails for rotation thereabout. In association with the upper rail assembly is a lower rail assembly with two parallel lower long side rails. Each of the lower rails has a hinge with vertical pivot pins adjacent to the midpoint thereof. The lower rail assembly also includes four lower corner brackets with pivot pins coupling the exterior remote ends of the lower rails to the lower corner brackets for oscillation of the lower rails about their axes and for pivoting with respect to the corner brackets. A pair of lower cross bars is included as part of the lower rail assembly. Each lower cross bar has exterior remote ends coupled to the lower rails at regions thereof intermediate the exterior remote ends and the mid-points of the lower rails for oscillating the lower rails about their axes and for rotating the cross rails with respect to the side rails. Each lower cross bar includes a hinge with horizontal pivot pins adjacent to the midpoints of the cross bars. Four vertical corner rails have upper ends fixedly secured to the four upper corner brackets and have lower ends fixedly secured to the four lower corner brackets.

1 Claim, 9 Drawing Sheets

70
76
78
74
74
60
70
74
44
60
78
76
44
60
60

COLLAPSIBLE PLAYYARD SYSTEM

BACKGROUND OF THE INVENTION

1. Field of the Invention

The present invention relates to a new and improved collapsible playyard system and, more particularly, pertains to supporting a child's playyard through a frame with increased safety, reliability and economy.

2. Description of the Prior Art

The use of playyards of various designs and configurations is known in the prior art. More specifically, playyards of various designs and configurations heretofore devised and utilized for the purpose of confining infants in a beneficial environment are known to consist basically of familiar, expected, and obvious structural configurations, notwithstanding the myriad of designs encompassed by the crowded prior art which has been developed for the fulfillment of countless objectives and requirements.

The prior art discloses a large number of playyards of various designs and configurations. By way of example, U.S. Pat. No. 4,811,437 issued to Dillner discloses a playyard with a complex frame structure including a single downwardly extending central support with bottom rails extending outwardly at various angles.

U.S. Pat. No. 4,985,948 to Mariol also discloses a playyard with a frame structure of a design which is complicated in its fabrication and which provides no central supports therebeneath and which requires the coupling of the lower portion of the fabric cover to a rectangular rail assembly through a hem.

Additional patents of interest with complex, expensive and unreliable frame structures are U.S. Pat. Nos. 5,377,368 and 5,381,570 to Cheng along with U.S. Pat. No. 5,615,427 to Huang.

In this respect, the collapsible playyard system according to the present invention substantially departs from the conventional concepts and designs of the prior art, and in doing so provides an apparatus primarily developed for the purpose of supporting a child's playyard through a frame with increased safety, reliability and economy.

Therefore, it can be appreciated that there exists a continuing need for a new and improved collapsible playyard system having a frame with increased safety, reliability and economy. In this regard, the present invention substantially fulfills this need.

SUMMARY OF THE INVENTION

In view of the foregoing disadvantages inherent in the known types of playyards of various designs and configurations now present in the prior art, the present invention provides a new and improved collapsible playyard system. As such, the general purpose of the present invention, which will be described subsequently in greater detail, is to provide a new and improved collapsible playyard system which has all the advantages of the prior art and none of the disadvantages.

To attain this, the present invention essentially comprises a collapsible playyard system comprising, in combination, an upper rail assembly positionable in a horizontal plane in a rectangular configuration when deployed including two parallel upper long side rails and two parallel upper short end rails, each of the upper rails having an operator-controlled hinge with horizontal pivot pins at the midpoint thereof adapted to allow each of the upper rails to pivot downwardly about their pivot pins when moving from the deployed orientation to the collapsed orientation, the upper rail assembly also including four upper corner brackets with hinges and horizontal pivot pins coupling the remote exterior ends of the four upper rails for rotation thereabout; a lower rail assembly positionable in a horizontal plane when deployed including two parallel lower long side rails located generally beneath the upper long side rails, each of the lower rails having a hinge with vertical pivot pins at the midpoint thereof adapted to allow each of the lower rails to pivot laterally about their pivot pins when moving from the deployed orientation to the collapsed orientation, each of the lower rails having remote exterior ends, the lower rail assembly also including four lower corner brackets with hinges and horizontal pivot pins coupling the exterior remote ends of the lower rails to the lower corner brackets, the exterior remote ends of the lower rails being circumferentially slotted for receiving the horizontal pivot pins of the lower corner brackets to allow for oscillation of the lower rails about their axes concurrently with their rotation with respect to the lower corner brackets, each lower rail including two Z-shaped sections adjacent to their associated corner brackets, the lower rail assembly also including a pair of lower cross bars, each lower cross bar having exterior remote ends coupled to the lower rails at regions thereof intermediate the exterior remote ends and the midpoints of the lower rails to allow rotation of the cross bars with respect to the side rails and oscillation of the side rails with respect to their axes, each lower cross bar including a hinge with a horizontal pivot pin adjacent to the midpoints of the cross bars adapted to pivot the lower cross bars upwardly when moving from the deployed orientation to the collapsed orientation; four vertical corner rails having upper ends fixedly secured to the four upper corner brackets and having lower ends fixedly secured to the four lower corner brackets; a central rail having a central hinge with horizontal pivot pins at the center thereof with remote exterior ends coupled adjacent to the midpoints of the cross bars whereby movement of the central hinge upwardly will cause the upward movement of the central extents of the cross bars to allow the lower rails to move upwardly about their midpoints, pivoting and oscillating at the lower corner brackets and, concurrently, allow the midpoints of the lower rails to move inwardly toward each other as the four vertical corner rails move to a central location therebetween for movement of the upper and lower rail assemblies to the collapsed orientation from the deployed orientation, the central hinge having a disk thereon with an operator-accessible handle thereon; and a fabric assembly in a rectilinear configuration having an open top with a rectangular hem at its upper edge receiving the upper rail assembly and having a lower generally rectangular horizontal floor positionable on the lower rail assembly with a central aperture for the passage of the handle therethrough, the fabric assembly also having four vertical rectangular panels coupling the upper edge and lower floor of the fabric assembly.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved collapsible playyard system which has all the advantages of the prior art playyards of various designs and configurations and none of the disadvantages.

It is a further object of the present invention to provide a new and improved collapsible playyard system which is of a durable and reliable construction with maximum safety.

It is another object of the present invention to provide a new and improved collapsible playyard system which may be easily, efficiently and economically manufactured and marketed and, in addition, may be reliably utilized, conveniently deployed and simply stowed.

An even further object of the present invention is to provide a new and improved collapsible playyard system which is susceptible of a low cost of manufacture with regard to both materials and labor, and which accordingly is then susceptible of low prices of sale to the consuming public, thereby making such a collapsible playyard system economically available to the buying public.

Lastly, it is an object of the present invention to provide a playyard frame. The frame has an upper rail assembly including two parallel upper long side rails and two parallel upper short end rails. Each of the upper rails has a hinge with a horizontal pivot pin at the midpoint thereof. The upper rail assembly also includes four upper corner brackets with hinges coupling the remote exterior ends of the four upper rails for rotation thereabout. In association with the upper rail assembly is a lower rail assembly which includes two parallel lower long side rails. Each of the lower rails has a hinge with pivot pins at the midpoint thereof for rotation about axes. The lower rail assembly also includes four lower corner brackets with hinges coupling the exterior remote ends of the lower rails to the lower corner brackets for rotation with respect to the lower corner brackets and concurrent oscillation of the lower rails about their axes. Four vertical corner rails have upper ends fixedly secured to the four upper corner brackets and have lower ends fixedly secured to the four lower corner brackets.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
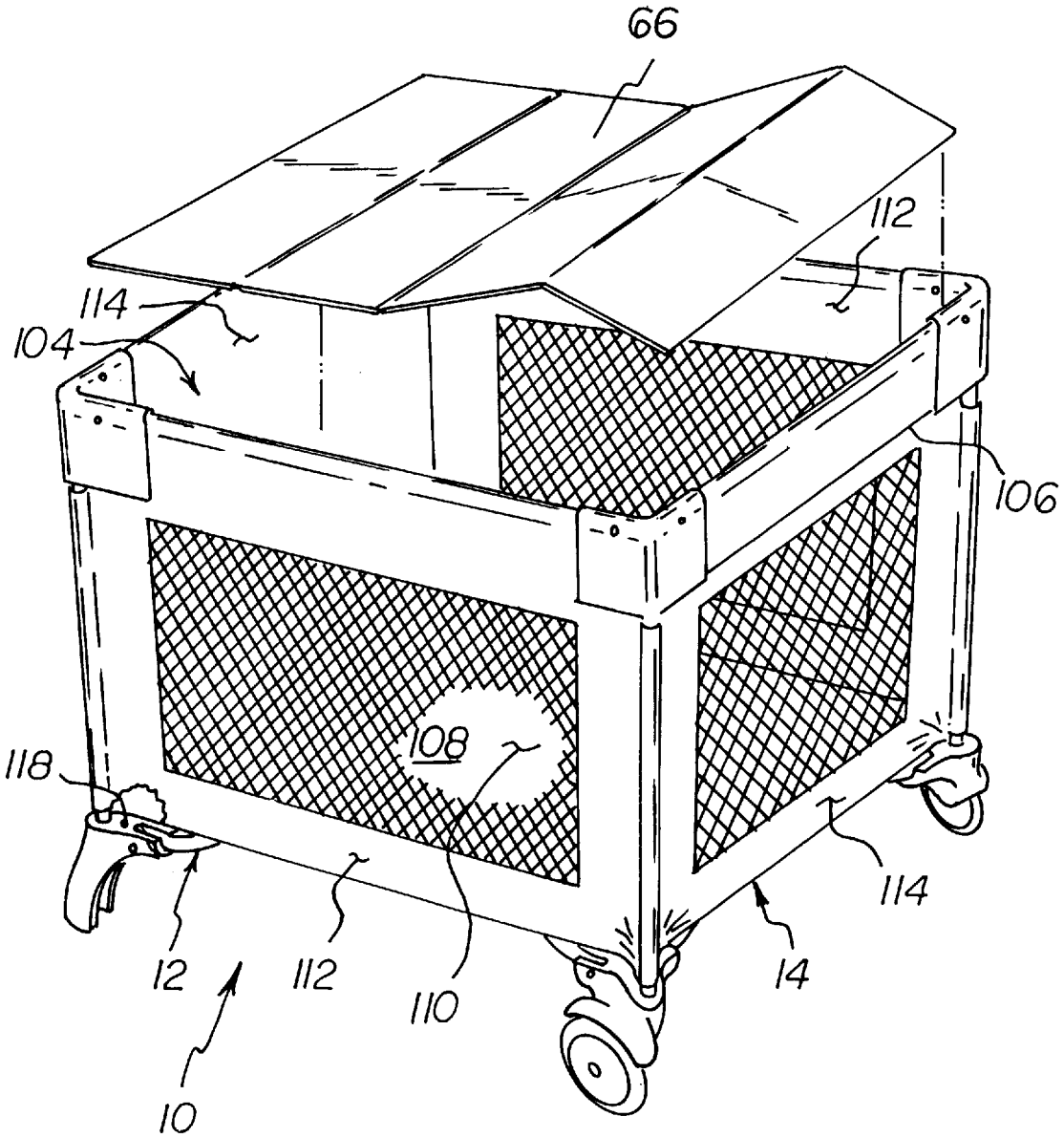
FIG. 1 is a perspective illustration of the preferred embodiment of the new and improved collapsible playyard system in the deployed orientation constructed in accordance with the principles of the present invention.
Figure 2:
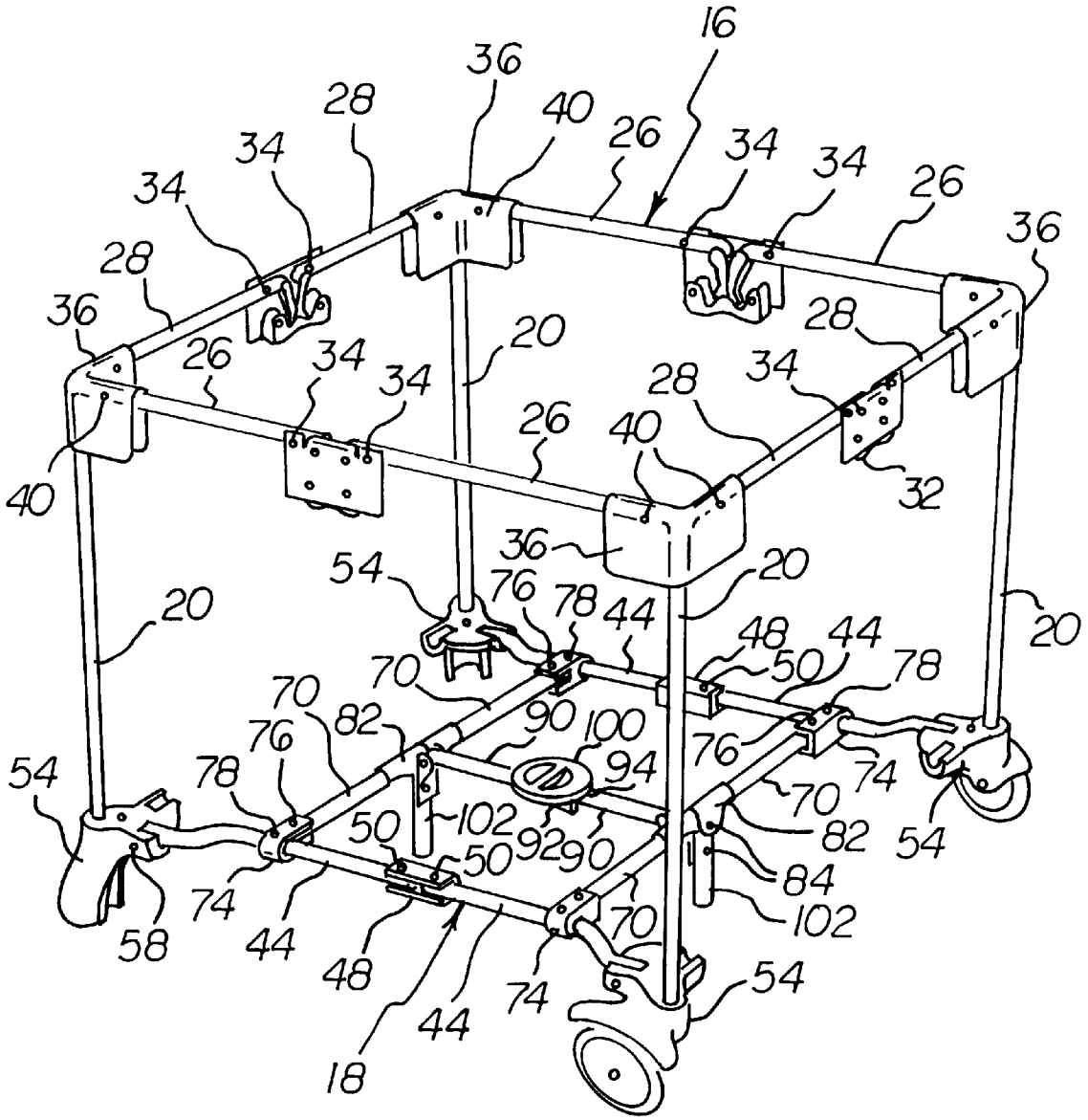
FIG. 2 is a perspective illustration of the frame as shown in FIG. 1 with the fabric assembly removed.
Figure 3:
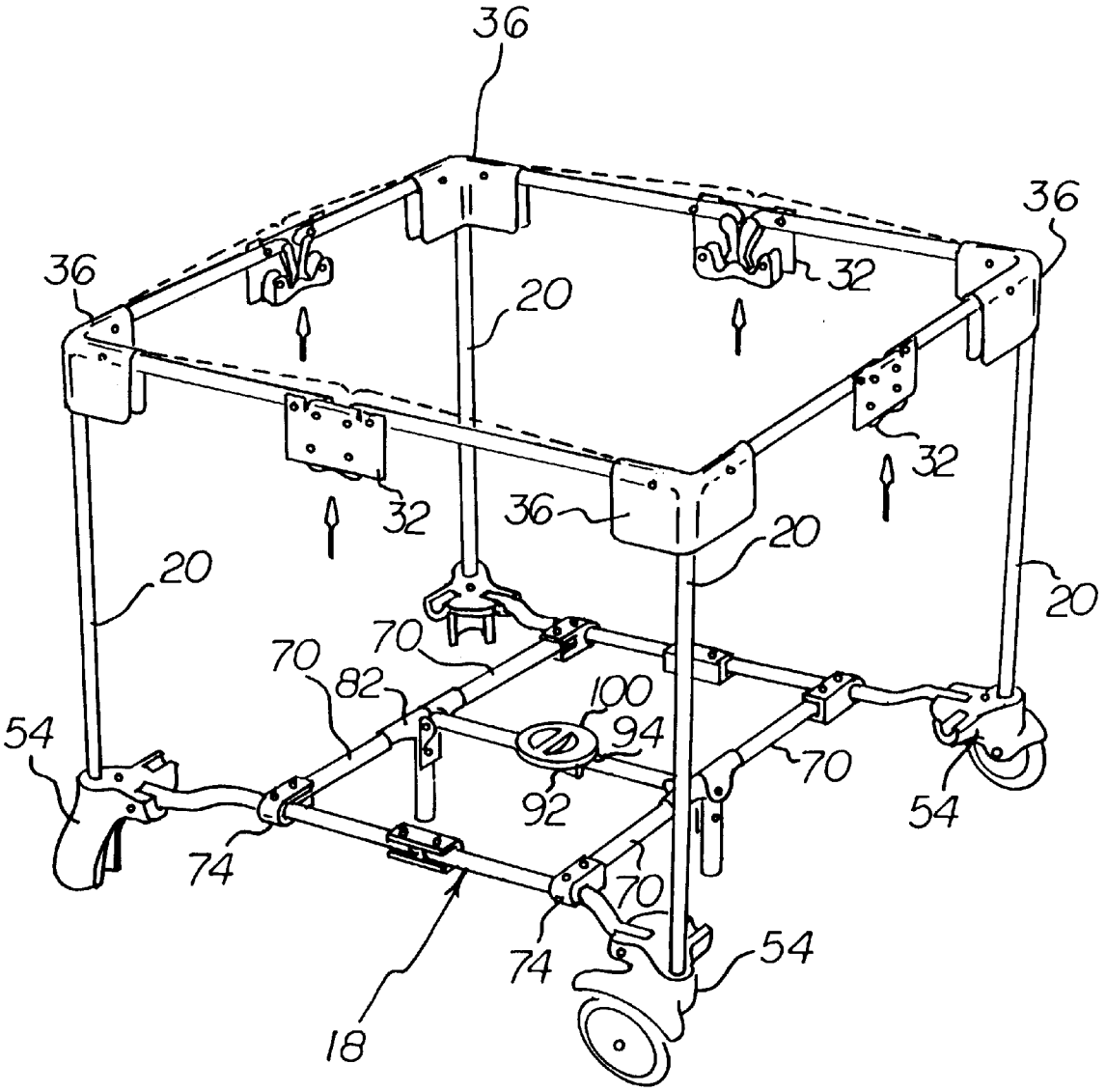
FIG. 3 is a view similar to FIG. 2, but with the upper hinges constricted in anticipation of conversion to the stored orientation.
Figure 4:
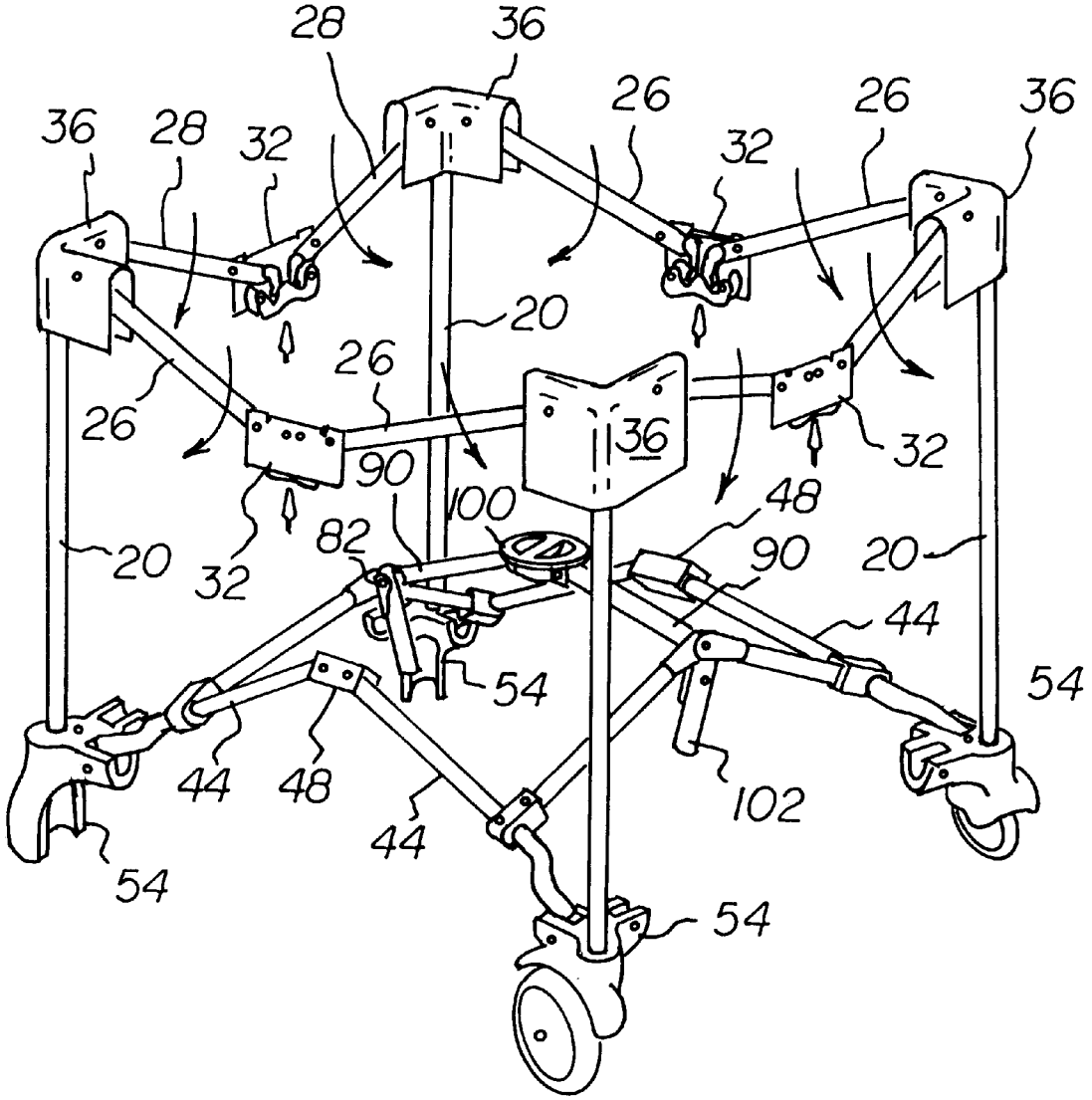
FIG. 4 is a perspective view similar to FIG. 3, but illustrating the frame in a partially collapsed orientation.
Figure 5:
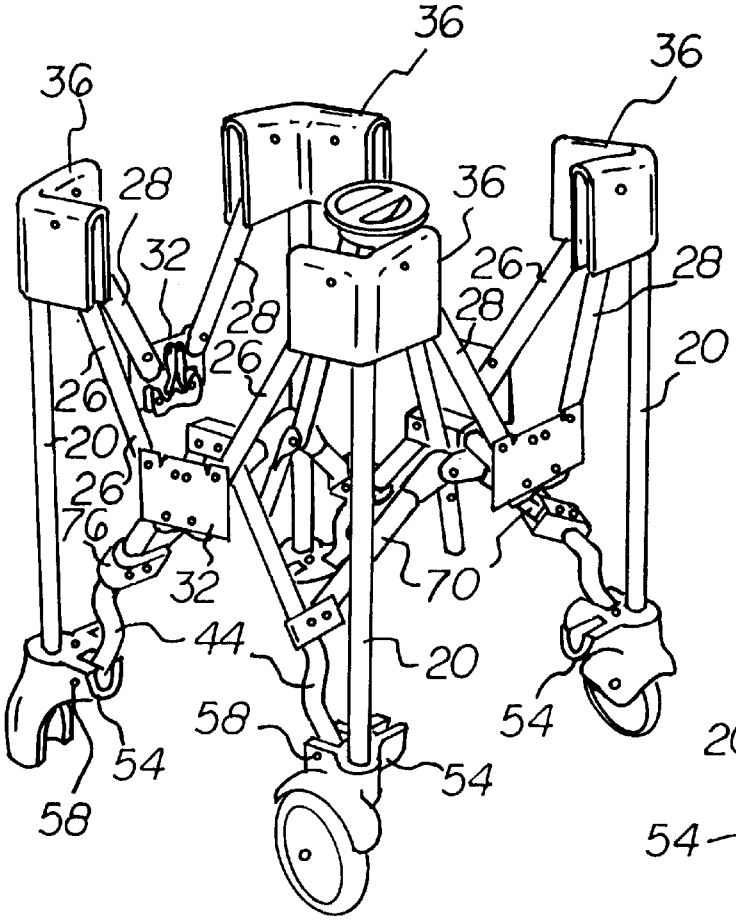
FIG. 5 is a perspective view similar to FIG. 4, but illustrating the frame in a nearly collapsed orientation.
Figure 6:
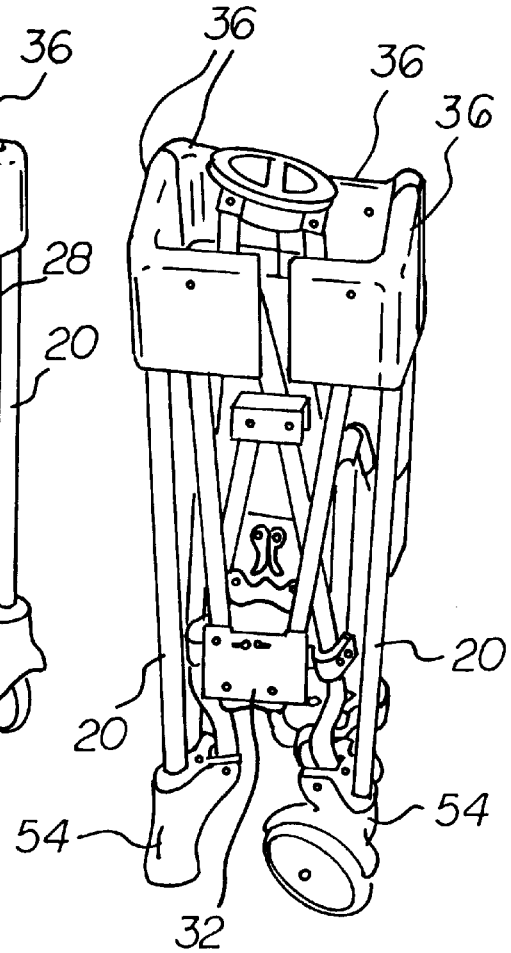
FIG. 6 is a perspective view similar to FIG. 5, but illustrating the frame in a fully collapsed orientation.
Figure 7:
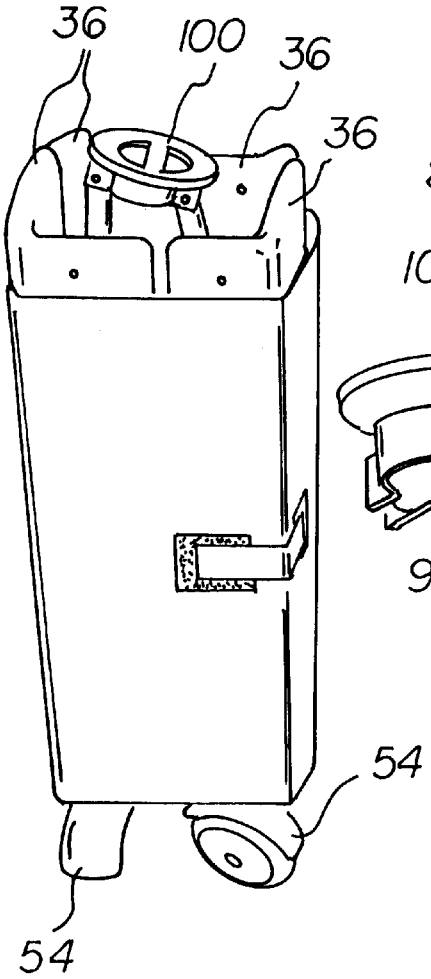
FIG. 7 is a perspective view similar to FIG. 6, but illustrating the frame in a fully collapsed orientation and with the pad positioned therearound for storage.

With reference now to the drawings, and in particular to the various Figures, the preferred embodiment of the new and improved collapsible playyard system embodying the principles and concepts of the present invention and generally designated by the reference numeral 10 will be described.

The present invention, the new and improved collapsible playyard system is a system 10 comprised of a plurality of components. The system has, as its two major components, a frame 12 and a fabric assembly 14. The frame 12 is composed of various assemblies including an upper rail assembly 16, a lower rail assembly 18, four vertical corner rails 20 and a handle 22. The components are specifically designed and configured with respect to each other for carrying out the intended objectives.

More specifically, the upper rail assembly 16 is adapted to be positionable in a horizontal plane when deployed. When deployed in a horizontal plane, the upper rail assembly 16 attains a rectangular configuration. As part of the upper rail assembly are two parallel upper side rails 26 and two parallel upper short end rails 28. Each rail is composed of two similarly sized and configured rail segments.

Figure 10:
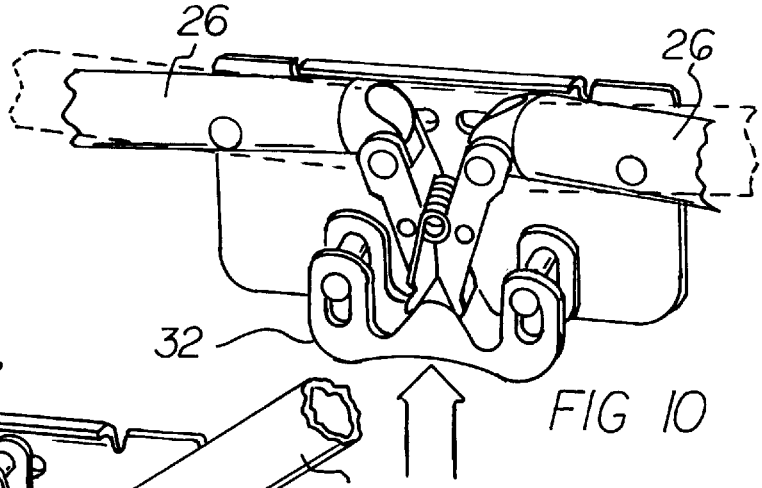
FIGS. 10, 11 and 12 illustrate one upper hinge in the deployed orientation, then in a rotated orientation preparatory to movement for the collapsed orientation and then in a partially collapsed orientation.
Figure 11:
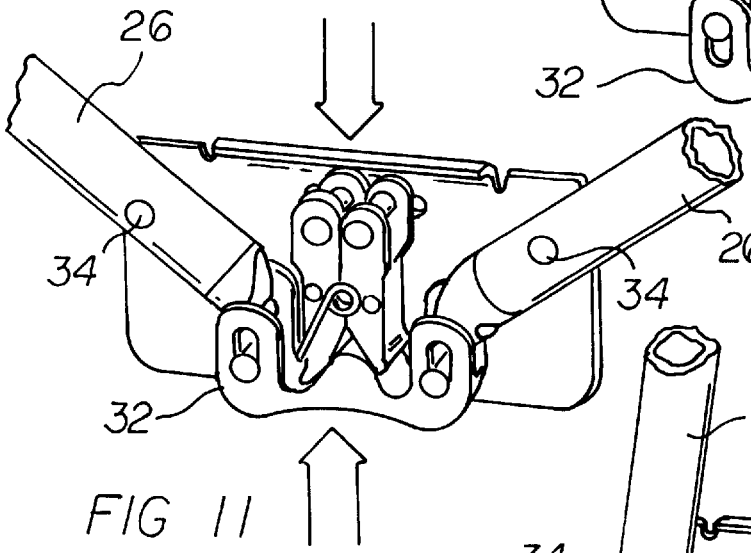
Figure 12:
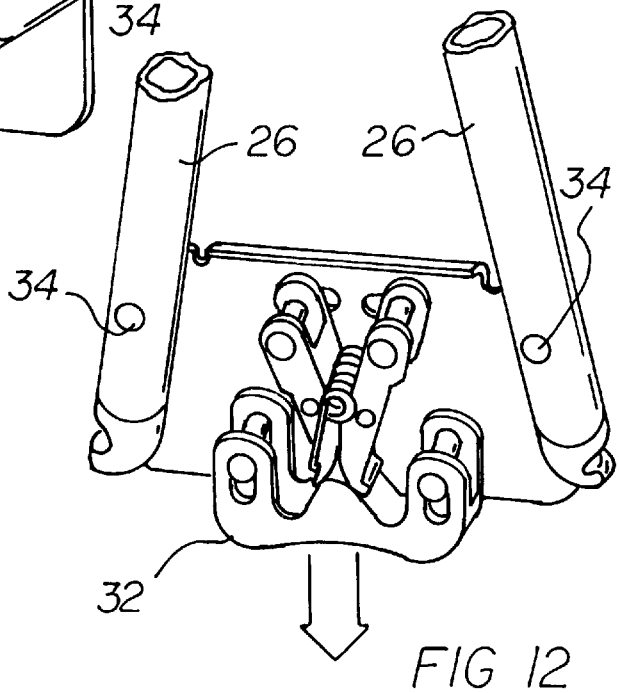

Each of the upper rails has a similarly configured operator-controlled hinge 32 with horizontal pivot pins 34 at the midpoint of the rails. The hinge 32 is preferably of the type disclosed in copending U.S. Patent Application No. P-4836, the subject matter of which is incorporated herein by reference. With reference to FIGS. 10 through 12, the hinges in the upper rail assembly are adapted to allow each of the upper rails to pivot downwardly about their horizontal pivot pins when moving from the deployed orientation to the collapsed orientation. The upper rail assembly also includes four upper corner brackets 36 with horizontal pivot pins 40 which constitute hinges. The hinges and pivot pins couple the remote exterior ends of the four upper rails to the associated corner brackets for rotation thereabout around horizontal axes.

The next component of the system, the lower rail assembly 18, is also positionable in a horizontal plane when deployed. The lower rail assembly includes two parallel lower long side rails 44. Such lower side rails are located generally beneath the upper long side rails but laterally interiorly thereof for the majority of their central extents. Each of the lower long side rails is formed of two similarly sized and configured rail segments. Each of the lower rails is provided with a hinge 48 with vertical pivot pins 50 located adjacent to the midpoint of the lower side rails. The hinges and pivot pins are adapted to allow each of the lower rails to pivot laterally about their pivot pins toward each other. Such movement occurs when moving from the deployed orientation to the collapsed orientation.

Figures 13, 14, 15:
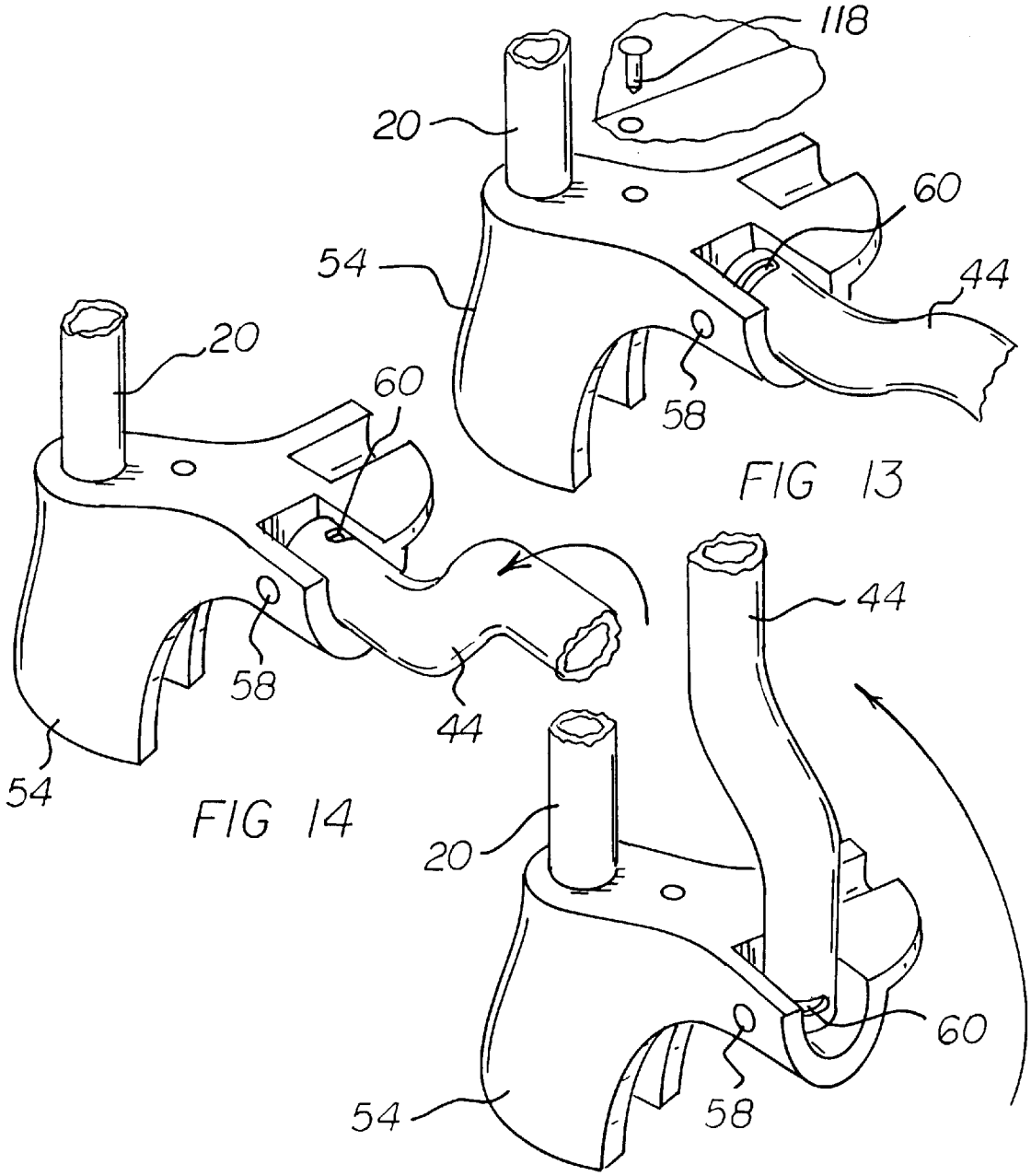
FIGS. 13, 14 and 15 illustrate one lower corner bracket and an associated lower side rail in the deployed orientation, then in a partially collapsed orientation and then in a fully collapsed orientation.
Figures 16, 17:
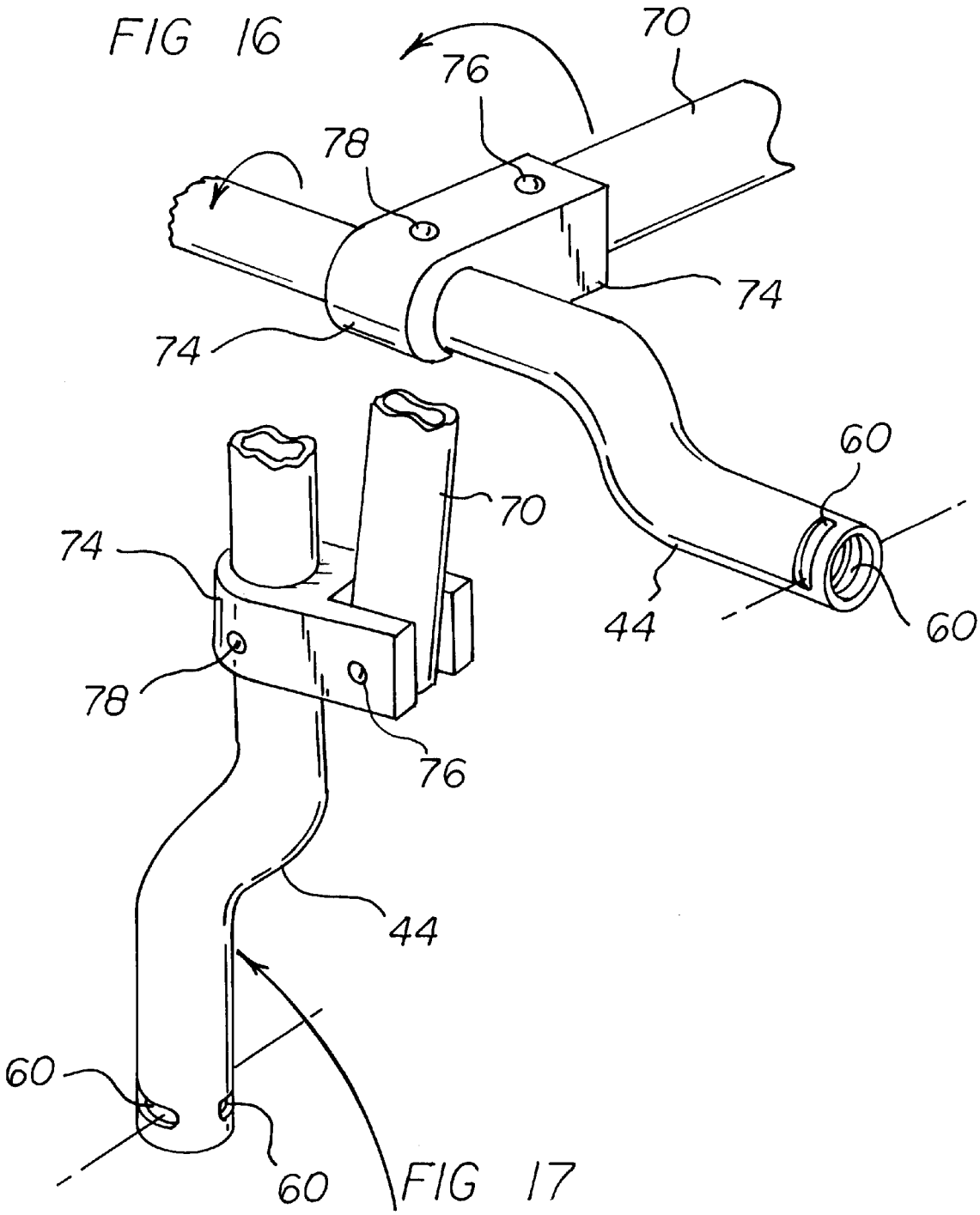
FIGS. 16 and 17 illustrate one hinge coupling a lower side rail and its associated cross rail in the deployed orientation and then in a partially collapsed orientation.

Each of the lower rails has remote exterior ends in association with four lower corner brackets 54. The corner brackets are provided with horizontal pivot pins 58 for pivotal coupling the exterior remote ends of the lower rails to the lower corner brackets. The exterior ends of the lower rails are also provided with circumferential slots 60 extending 90 degrees for receiving the horizontal pivot pins of the lower corner brackets. This arrangement allows for oscillation of the lower rails about their axes concurrently with their rotation with respect to the lower corner brackets. Compare the showings of FIGS. 13, 14 and 15.

Note is taken that each lower rail includes two generally Z-shaped sections 64. Such sections are located adjacent to their associated corner brackets. This allows the lower rails to provide support along the majority of their extents for a child-supporting pad 66 located thereon. The support is located interiorly of the periphery of the pad and its supporting floor of the fabric panel as will be described hereinafter. Such pad is preferably of the conventional type formed of four rectangular panels of a similar size and shape held together by fabric above and below. Stitching is provided through the fabric around its periphery and linearly between the panels. Padding is located between the panels and fabric for comfort. The pad may be laid flat on the floor of the fabric assembly with its corners resting on the lower corner brackets for support. The pad may also be removed and wrapped around the frame when in the stowed or stored orientation. Connectors of a pile type fastener are provided at opposed edges of the pad to hold the entire system in a generally rectilinear configuration.

The lower rail assembly also includes a pair of lower cross bars 70. Each lower cross bar has exterior remote ends coupled to the lower rails as by a bracket 74 fixedly attached by rivets 76 at regions thereof intermediate the exterior remote ends and the midpoints of the lower rails. Rivets 78 couple the remote ends to the hinge and allow for rotation of the cross bars with respect to the brackets. This coupling allows the cross bars to be at right angles to the lower side rails when deployed and to be parallel with lower side rails when in the stowed orientation. Movement of the cross rails oscillates the lower side rails about their axes and concurrently rotates the cross bars through 90 degrees with respect to the lower side rails. Lateral support is thus provided to the floor and mat interiorly of the periphery of the playyard.

Each lower cross bar also includes a hinge 82 with horizontal a pivot pin 84 adjacent to the midpoints of the cross bars. This is adapted to allow pivoting of the lower cross bars upwardly at their midpoints when moving from the deployed orientation to the collapsed orientation.

As is conventional in the art, there are provided four vertical corner rails 20. Each vertical corner rail has an upper free end fixedly secured to an associated upper corner bracket 36. Each vertical corner rail also has a lower free end fixedly secured an associated one of the lower corner brackets 54. The vertical corner rails maintain the upper and lower frame assemblies in their proper spaced orientation during deployment. The lower corner brackets provide peripheral support to the playyard through the fabric floor and pad thereover during operation and use.

Figure 8:
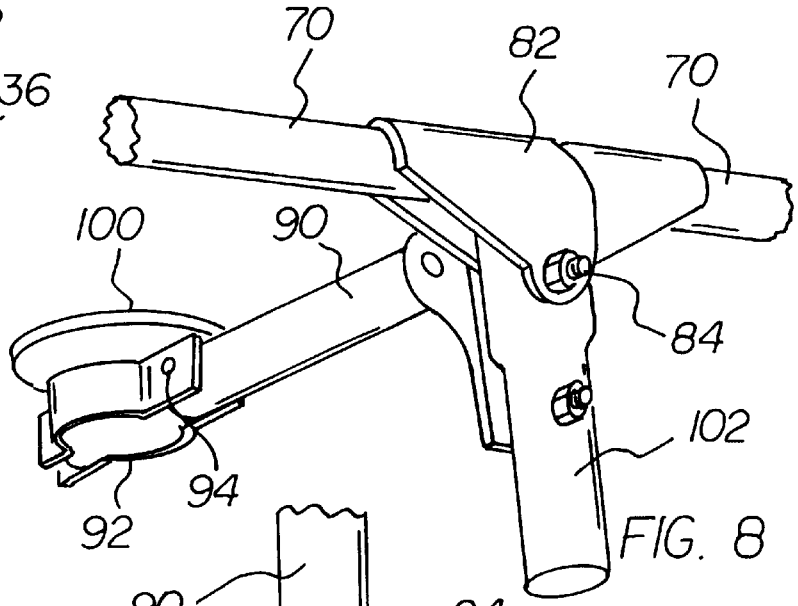
FIGS. 8 and 9 illustrate the coupling of a cross rail and one end of the central rail in both the deployed orientation and the partially collapsed orientation.
Figure 9:
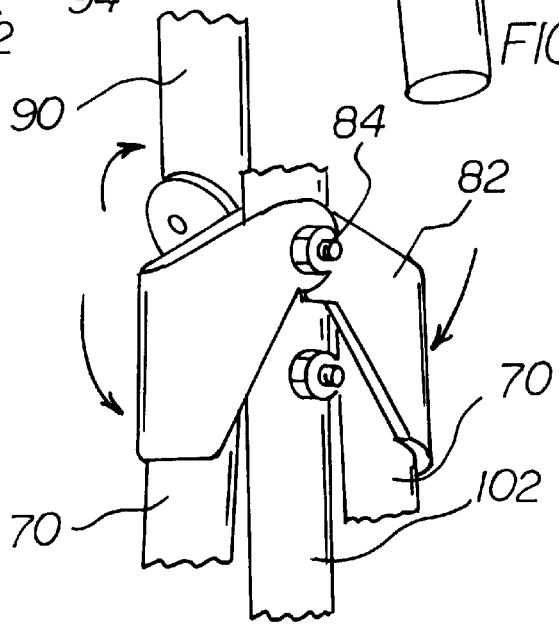

Next provided is a central rail 90. Such central rail is formed to include opposing ends as well as a central hinge 92 with horizontal pivot pins 94. Regions of the central rail adjacent to its opposing ends are pivotally coupled through horizontal pivot pins 96 to the hinges 74 adjacent to the midpoints of the cross bars, preferably at the hinges. This is best seen in FIGS. 8 and 9. In this manner, movement of the central hinge upwardly will cause the upward movement of the central extents of the cross bar concurrently with their rotation into parallelism with respect to the lower side rails. Compare FIGS. 3 through 6. This in turn allows the lower rails to move upwardly about their midpoints while pivoting and also oscillating about their axes at the lower corner brackets. Concurrently, this allows the midpoints of the lower rails to move inwardly toward each other as the four vertical corner rails move to a central location. This movement of the lower rail assembly, in association with the downward movement of the central extents of the upper rail assemblies, effects the movement of the playyard and its frame from the deployed orientation to the collapsed orientation and vice versa as desired by an operator.

The central hinge also includes a disk or plate 100 secured thereabove. Formed within the upper surface of the disk is an operator-accessible handle 22 preferably recessed therein. In addition, each hinge at the middle of the central rail includes a downwardly extending leg 102 pivotally coupled to its associated hinge to provide additional central support to the lower frame assembly when deployed. Apptopriate coupling linkages allow for the pivoting of the legs 102 through 90 degrees when moving between the deployed and stowed orientations.

As shown in FIG. 1, there is also provided as a component of the system, a fabric assembly 14. The fabric assembly is in a rectilinear configuration. It has an open top 104. It also has a rectangular hem 106 at its upper edge. Such hem is for receiving the upper rail assembly. Four vertical hems also encompass the corner rails. The fabric assembly also has a lower generally rectangular horizontal floor 108. The floor is positionable on the lower rail assembly. The upper surface of the floor is adapted to receive a pad as described above. With the pad removed and the floor exposed, there can be seen a central aperture 110. Such aperture is for the operator access of the handle therethrough for manipulation by an operator. Movement of the handle upwardly through the aperture allows the collapsing of the playyard upon the lifting of the central hinge. The fabric assembly also has four vertical rectangular panels, two large side panels 112, and two small end panels 114. The panels are coupled at their lateral edges one to another and at the upper edge to the upper frame assembly and at their lower edges to the floor of the fabric assembly.

Coupling between the frame and the fabric assembly is also achieved by a rivet 118 at each corner of the fabric floor coupling the four lower corner brackets. Other couplings could be provided, as for example, pile type fasteners, hook and eye fasteners, etc.

When the pad 66 is located upon the fabric floor 108 during operation and use, support will be provided at the lower periphery by the lower corner brackets. Support will also be provided interiorly of the periphery by the lower long side rails spaced apart by a distance less than the distance between the long upper side rails and by the cross rails spaced apart by a distance less than the distance between the upper short end rails. Support will also be provided adjacent to the central region of the pad and floor by the downwardly extending legs of the central rail.

Note is taken that there is no central leg extending downwardly from the plate 100 at the lower center of the frame. An unencumbered space is beneath the plate. This allows a user to push downwardly on such plate upon deployment of the frame and system. The upper frame assembly is in an upper horizontal plane when deployed while the lower frame assembly is in a lower horizontal plane beneath the upper plane. Pushing downwardly on the plate when in the deployed orientation forces the plate and adjacent bars and rails downwardly beneath the lower horizontal plane to create an over center relationship with supplemental tension forces in the lower frame assembly. Such forces are transferred through the vertical corner rails to the upper rail assembly. The supplemental tension forces now create an interference fit between the exterior ends of the upper rails and the upper corner brackets. As such, unintentional release of the upper hinges and upper frame assembly is abated. Unintentional release of the upper hinges during system deploment is achieved by configuring the upper rails with the hinges slightly above the horizontal plane of the upper rails. This is another over center relationship creates an additional interference fit between the locking pins and the associated notches of the block. Constriction of the upper hinges and release of the upper hinges and upper frame assembly along with the folding of the upper rails can only be effected by relieving the supplemental tension forces as occurs by pulling upwardly on the handle on top of the plate at the center of the lower frame assembly. Conversely, the center plate must be raised in order to lock the upper hinges.

As to the manner of usage and operation of the present invention, the same should be apparent from the above description. Accordingly, no further discussion relating to the manner of usage and operation will be provided except to note that the above-described steps to convert the frame and playyard from the deployed orientation to the collapsed or stored orientation are simply reversed when converting the frame and playyard from the collapsed or stowed orientation to the deployed orientation for operation and use.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A collapsible playyard system comprising, in combination:

an upper rail assembly positionable in a horizontal plane in a rectangular configuration when deployed including two parallel upper long side rails and two parallel upper short end rails, each of the upper rails having an operator-controlled hinge with a horizontal pivot pin at the midpoint of each of the upper rails adapted to allow each of the upper rails to pivot downwardly about their pivot pins when moving from the deployed orientation to the collapsed orientation, the upper rail assembly also including four upper corner brackets with hinges and horizontal pivot pins coupling the remote exterior ends of the four upper rails for rotation thereabout;

a lower rail assembly positionable in a horizontal plane when deployed including two parallel lower long side rails located generally beneath the upper long side rails, each of the lower rails having a hinge with vertical pivot pins at the midpoint of each of the lower rails adapted to allow each of the lower rails to pivot laterally about their pivot pins when moving from the deployed orientation to the collapsed orientation, each of the lower rails having remote exterior ends, the lower rail assembly also including four lower corner brackets with hinges and horizontal pivot pins coupling the exterior remote ends of the lower rails to the lower corner brackets, the exterior ends of the lower rails being circumferentially slotted for receiving the horizontal pivot pins of the lower corner brackets to allow for oscillation of the lower rails about their axes, each lower rail including two Z-shaped sections adjacent to their associated corner brackets, the lower rail assembly also including a pair of lower cross bars, each lower cross bar having exterior remote ends coupled to the lower rails at regions thereof intermediate the exterior remote ends and the midpoints of the lower rails, each lower cross bar including a hinge with horizontal pivot pins adjacent to the midpoints of the cross bars adapted to pivot the lower cross bars upwardly when moving from the deployed orientation to the collapsed orientation;

four vertical corner rails having upper ends fixedly secured to the four upper corner brackets and having lower ends fixedly secured to the four lower corner brackets;

a central rail having a central hinge with horizontal pivot pins at the center thereof and with remote exterior ends coupled adjacent to the midpoints of the cross bars whereby movement of the central hinge upwardly will cause the upward movement of the central extents of the cross bars to allow the lower rails to move upwardly about their midpoints, pivoting and oscillating at the lower corner brackets and, concurrently, allow the midpoints of the lower rails to move inwardly toward each other as the four vertical corner rails move to a central location therebetween for movement of the upper and lower rail assemblies to the collapsed orientation from the deployed orientation, the central hinge having a disk thereon with an operator accessible strap thereon; and a fabric assembly in a rectilinear configuration having an open top with a rectangular hem at its upper edge receiving the upper rail assembly and having a lower generally rectangular horizontal floor positionable on the lower rail assembly with a central aperture for the passage of the central hinge therethrough, the fabric assembly also having four vertical rectangular panels coupling the upper edge and lower floor of the fabric assembly.

* * * * *